United States Patent [19]

Wieczorek

[11] Patent Number: 4,967,959

[45] Date of Patent: Nov. 6, 1990

[54] FUEL INJECTOR HAVING FLAT SEAT AND NEEDLE FUEL SEAL

[75] Inventor: David P. Wieczorek, Newport News, Va.

[73] Assignee: Siemens-Bendix Automotive Electronics L.P., Troy, Mich.

[21] Appl. No.: 370,414

[22] Filed: Jun. 22, 1989

[51] Int. Cl.[5] ..... F02M 51/06; F02M 61/18

[52] U.S. Cl. ..... 239/104; 239/533.2; 239/533.11; 239/585

[58] Field of Search ..... 239/104, 533.2–533.12, 239/584, 585

[56] References Cited

U.S. PATENT DOCUMENTS

| | | | |
|---|---|---|---|
| 1,323,778 | 12/1919 | Lemp | 239/585 |
| 1,919,904 | 7/1933 | Pielstick | 239/584 X |
| 2,317,749 | 4/1943 | Fischlmayr | 239/584 |
| 2,927,737 | 3/1960 | Zeuch et al. | 239/533.3 |
| 2,957,631 | 10/1960 | Armstrong | 239/533.8 |

*Primary Examiner*—Andres Kashnikow

*Assistant Examiner*—William Grant

*Attorney, Agent, or Firm*—George L. Boller; Russel C. Wells

[57] ABSTRACT

An electromagnetic fuel injector has a raised seat with which the needle tip coacts to open and close the injector as the injector is operated. The raised seat has an annular transverse seating surface surrounding a hole through the seat member. The hole through the seat member has a frusto-conically shaped surface immediately contiguous the annular seating surface, and the tip of the injector needle is conically shaped. The cone angle of the needle tip is greater than the cone angle of the frusto-conically shaped hole in the seat member, and the needle tip and the annular transverse surface of the seat are almost parallel so that the needle tip seats on the annular transverse surface of the seat at the rim of the frusto-conically shaped hole when the injector closes. The seat is softer than the needle so that the seal is initially good and becomes better as the injector is operated.

2 Claims, 1 Drawing Sheet

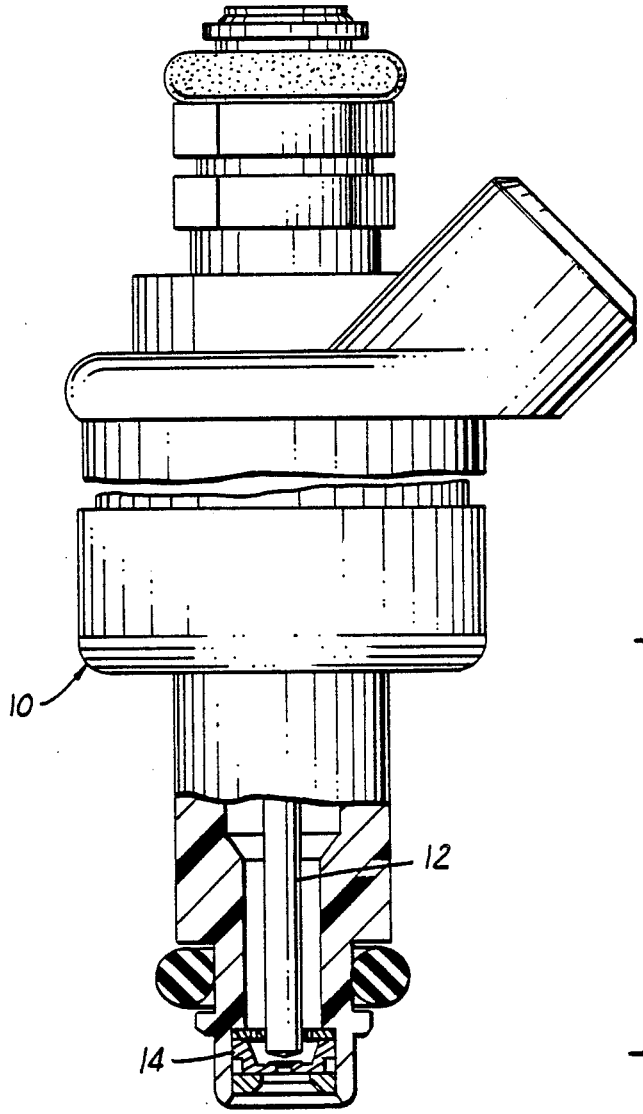
FIG. 1
FIG. 2
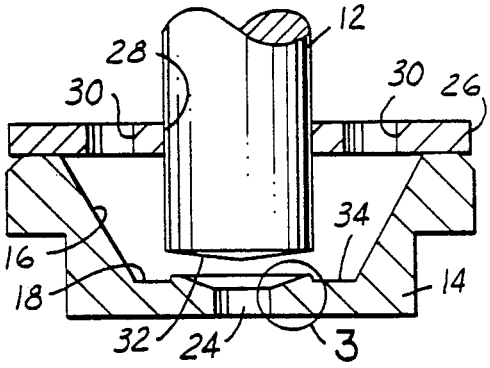
FIG. 3
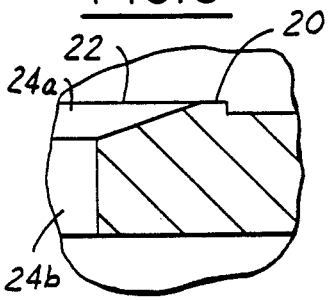

FUEL INJECTOR HAVING FLAT SEAT AND NEEDLE FUEL SEAL

BACKGROUND AND SUMMARY OF THE INVENTION

This invention relates generally to electromagnetic fuel injectors. More specifically it relates to a new and unique flat seat and needle fuel seal in an electromagnetic fuel injector.

The fuel injector that is illustrated in U.S. Pat. No. 4,610,080, commonly assigned, is representative of one known type of fuel injector. The needle has a rounded tip that seats in a frusto-conically shaped hole that is centrally located in a seat member that disposed at the tip end of the injector. A guide member is affixed to the interior face of the seat member and comprises a hole that is accurately aligned to the frusto-conical hole in the seat member. As the needle is displaced by operation of the injector's electromagnetic solenoid, the hole in the guide member guides the needle axially into and out of seating engagement with the frusto-conical hole in the seat member. The guide member has several holes that are located radially outwardly of its central guide hole, and these several holes serve to convey fuel past the guide member and toward the seat member.

The present invention relates to a new construction for the seat member and the needle wherein the two are constructed to have what are essentially flat parallel mating surfaces that provide a good initial seal when the injector closes and whose interface plastically conforms during continued operation of the injector to produce an even better seal. The invention provides improved sealing over the life of the injector, de-sensitizes the fuel flow vs. stroke characteristic of the injector, and reduces the alignment sensitivity resulting in reduced dependency on precision manufacturing operations. The invention also provides a particle trap that can reduce the chances of a foreign particle falling between the needle and seat.

The foregoing features, advantages, and benefits of the invention will be seen in the ensuing description and claims which should be considered in conjunction with the accompanying drawings. The drawings disclose a preferred embodiment of the invention in accordance with the best mode contemplated at the present time in carrying out the invention.

BRIEF DESCRIPTION OF THE DRAWINGS

FIG. 1 is a view, having portions broken away, of a fuel injector embodying principles of the invention.

FIG. 2 is a fragmentary enlarged view of a portion of FIG. 1.

FIG. 3 is a fragmentary enlarged view taken in circle 3 of FIG. 2.

DESCRIPTION OF THE PREFERRED EMBODIMENT

The construction of the fuel injector 10 that is shown in the drawings is like that contained in U.S. Pat. No. 4,610,080 except for the needle 12 and the seat member 14. The seat member comprises a frusto-conically shaped inside wall 16 and a flat transverse wall 18. Disposed centrally on wall 18 within the confines of wall 16 is a raised seat 20. Seat 20 has a flat transverse seating surface 22 which is of circular annular shape. Surface 22 bounds a through-hole 24 which comprises a frusto-conically tapered portion **24*a* and a circular cylindrical portion 24*b***.

A needle guide member 26 is affixed to the rim of seat member 14 and comprises a circular hole 28 that is precisely aligned with hole 24. Needle 12 fits very closely within hole 28 so as to be accurately guided for axial travel to and from seat 24. Member 26 also contains several through-holes 30 in radially outwardly spaced relation to hole 28, and in the condition of the injector portrayed in FIGS. 1 and 2 showing needle 12 unseated from seat 24, fuel can flow through these holes 30, and through member 14, exiting via hole 24.

The tip end 32 of needle 12 is conically shaped. Its cone angle is greater than the cone angle of hole portion **24*a* so that when the tip end of the needle seats on seat 20, the seating contact is with surface 22 just at the rim of portion 24*a*. For purposes of illustration in the drawing Figs., the cone angle of the needle tip is somewhat smaller than is actually the case in the actual embodiment of injector. By way of example, if surface 22** lies in a flat plane that is exactly perpendicular to the axis of the needle, the cone angle of the needle tip may be 88 degrees plus or minus one and one half degrees. Thus, the needle tip surface and the seat surface may be considered as two flat and nearly parallel surfaces.

In accordance with further principles of the invention, needle 12 is made of a hardened stainless steel while seat member is made of a softer stainless steel, such as 416 stainless steel. The result of such construction is that a newly fabricated injector will have good initial sealing of the needle to the seat when the injector closes, and the sealing will improve as the injector is operated. This attribute is achieved in conjunction with several other attributes. One, there is reduced lateral alignment sensitivity which can ease manufacturing considerations, such as reduced tolerances and reduced surface finish requirements. Two, there is reduced flow vs. lift sensitivity due to a more efficient fluid flow path resulting in improved linear range capabilities and decreased minimum operating voltage.

Yet another feature of the invention is the provision of a well 34 around seat 20. The well provides a particle trap around the seat and reduces the chances of minute foreign particles falling between the needle and the seat.

While a preferred embodiment of the invention has been disclosed, principles may be applied to other embodiments.

What is claimed is:

1. In an electromagnetic-operated fuel injector of the type comprising an injector body having a fuel passage terminating at a tip end at which fuel is emitted, a seat member disposed at said tip end, said seat member comprising a transverse wall containing a hole through which fuel passes, an axially reciprocal needle having a tip end that coacts with said seat member to open and close said hole in response to operation of the fuel injector, and a needle guide member that is coaxial with said seat member, said needle guide member having a guide hole that guides the axial reciprocation of said needle to and from said seat member and one or more additional holes through which fuel passes through said needle guide member toward said seat member, the improvement which comprises said seat member having a seat on said transverse wall that is raised toward the tip end of said needle and an annular well surrounding said raised seat, said seat comprising a flat annular surface surrounding the hole in said seat member and disposed perpendicular to the axial reciprocation of said needle, the surface portion of the hole in said seat member that is immediately contiguous said flat annular surface being of a frusto-conical shape which tapers inwardly in the direction away from said needle, the tip end of said needle being of a conical shape whose cone angle is greater than the cone angle of the frusto-conical surface portion of the hole in said seat member and just slightly less than a right angle so that when said needle is operated to close the hole in said seat member, an annular shaped portion of the conically shaped tip end of the needle seats on said flat annular surface of said seat at the rim of said frusto-conical surface portion of the hole in said seat member, and wherein the tip end of said needle and said flat annular surface and the immediately contiguous frusto-conical shaped surface portion of said seat have different hardnesses.

2. The improvement set forth in claim 1 in which the tip end of said needle is harder than said flat annular surface and the immediately contiguous frusto-conical shaped surface portion of said seat.

* * * * *